US005259595A

United States Patent [19]

Nagasaka et al.

[11] Patent Number: 5,259,595

[45] Date of Patent: Nov. 9, 1993

[54] PRESSURE POURING FURNACE

[75] Inventors: Yasuo Nagasaka; Masahiro Isogai; Hideharu Motobayashi, all of Aichi; Shizuo Hayashi, Kanagawa; Kiyokazu Kawanishi, Kanagawa; Akio Kaneshiro, Kanagawa, all of Japan

[73] Assignees: Fuji Electric Co., Ltd., Kanagawa; Inax Corporation, Aichi, both of Japan

[21] Appl. No.: 851,680

[22] Filed: Mar. 12, 1992

[30] Foreign Application Priority Data

Mar. 13, 1991 [JP] Japan ..... 3-47074

[51] Int. Cl.[5] ..... B22D 41/50

[52] U.S. Cl. ..... 266/239; 222/597

[58] Field of Search ..... 266/239, 236; 222/591, 222/597, 600

[56] References Cited

U.S. PATENT DOCUMENTS

| | | | |
|---|---|---|---|
| 2,364,615 | 12/1944 | Beckes | 222/591 |
| 3,193,891 | 7/1965 | Funk, Jr. | 266/239 |
| 3,844,453 | 10/1974 | Eickelberg | 222/399 |
| 4,498,661 | 2/1985 | Kobzar | 266/239 |

FOREIGN PATENT DOCUMENTS

| | | |
|---|---|---|
| 0008858 | 3/1980 | European Pat. Off. . |
| 1508560 | 12/1969 | Fed. Rep. of Germany . |
| 2361934 | 7/1974 | Fed. Rep. of Germany . |
| 2613173 | 9/1977 | Fed. Rep. of Germany . |
| 2727257 | 12/1978 | Fed. Rep. of Germany . |
| 62-10952 | 1/1987 | Japan . |
| 62-50860 | 7/1987 | Japan . |
| 63-7422 | 4/1988 | Japan . |
| 2-25269 | 3/1990 | Japan . |
| 1442997 | 7/1976 | United Kingdom . |

*Primary Examiner*—Scott Kastler

*Attorney, Agent, or Firm*—Finnegan, Henderson, Farabow, Garrett & Dunner

[57] ABSTRACT

A pressure pouring furnace includes a molten metal chamber containing molten metal within a furnace body, a receiving siphon and a pouring siphon both communicating with each other at the bottom of the molten metal chamber, a furnace cover sealably covering the top of the molten metal chamber, and a pressuring unit connected to the furnace cover. In such a furnace, a plurality of pouring nozzles are arranged above a pouring chamber on top of the pouring siphon a distance apart from each other, and each of the plurality of pouring nozzles is provided with a stopper enabling it to be opened and closed from above.

12 Claims, 3 Drawing Sheets

PRESSURE POURING FURNACE

BACKGROUND OF THE INVENTION

The present invention relates to a pressure-type pouring furnace, and more particularly to an art to be applied to a casting line consisting of a series of mold frames, each mold frame having a plurality of pouring gates.

Conventional pressure-type pouring furnaces are disclosed, e.g., in Japanese Patent Unexamined Publication No. Hei. 2-25269 and Japanese Utility Model Unexamined Publications Nos. Sho. 62-10952 and Sho. 62-50860. Each of these furnaces includes a molten metal chamber containing molten metal within the furnace body, a receiving siphon and a pouring siphon communicating with each other at the bottom of the molten metal chamber, a furnace cover sealably covering the top of the molten metal chamber, and a pressuring unit connected to the furnace cover. Some of these furnaces further include pouring nozzle on a pouring chamber on top of the pouring siphon, with a single pouring nozzle being shown on the pouring chamber. Further, a pressure-type pouring furnace using a stopper on the pouring nozzle is disclosed in Japanese Utility Model Examined Publication No. Sho. 63-7422. However, in the case of producing small castings such as taps, a mold frame is often designed to include two or more molds, each mold having its own pouring gate. Thus, various techniques have been devised to pour the molten metal from the single pouring nozzle of the pressure-type pouring furnace to the casting line consisting of a series of mold frames having a plurality of pouring gates.

FIG. 3 is a time chart for FIG. 4 which shows an operation plan of a conventional example 1; FIG. 4 is a plan view showing the operation plan of the conventional example 1; FIG. 5 is a plan view showing an operation plan of a conventional example 2; and FIG. 6 is a plan view showing an operation plan of a conventional example 3. In FIGS. 3 through 6, reference characters $x_w$, $x_p$ designate a pitch at which the mold frames are arranged and a pitch at which the pouring gates within a single mold frame are arranged, both pitches not only satisfying a relationship $x_z = x_w - x_p$, but also indicating a direction of movement of the casting line with "y" indicating a direction of movement orthogonal thereto. Reference characters $t_1$, $t_2$ designate moved positions at different timings on the same casting line with the respective symbols indicating a pouring gate not pouring, ○; having poured, ●; and during pouring, ◎. In FIGS. 3 and 4, the line repeats its movements $x_p$, $x_z$ for time intervals $W_p$, $W_z$, and the molten metal is poured to a pouring gate A and a pouring gate B for time intervals $P_a$, $P_b$ when the line is stopped. Examples of time interval are as shown in FIG. 3, and a single cycle lasts 31 seconds as shown in FIG. 3. In FIG. 5, which shows the conventional example 2, an auxiliary conveyor making the movement $x_p$ is located immediately below the pouring nozzle, while main conveyors, each making the movement $x_w$, are located ahead and behind the auxiliary conveyor. In FIG. 6, showing the conventional example 3, auxiliary conveyors making the movements $x_p$ and $x_z$ are located immediately below the pouring nozzle, and a main conveyor making the movement $x_w$ runs in parallel thereto. Time charts for the plans shown in FIGS. 5 and 6 will not be shown.

The above conventional art allows the single pouring nozzle of the pressure-type pouring furnace to pour the molten metal into the casting line consisting of a series of mold frames having a plurality of pouring gates. However, since the mold frame arrangement pitch rarely coincides with a value exactly twice the pitch of the pouring gates of a single mold frame, the line must repeat differently distanced movements $x_p$, $x_z$, for different time intervals $W_p$, $W_z$, or the main and auxiliary conveyors must be employed, etc., which, as a result, makes the casting line forwarding mechanism complicated. In addition, the casting process is long with its pouring operation performed one by one by the pouring gates A, B. On the other hand, an attempt to move a pressure-type pouring furnace with a casting line of simple design is problematic in practically achieving the frequent movement of the pouring furnace with the molten metal contained therein.

SUMMARY OF THE INVENTION

An object of the invention is to provide a pressure-type pouring furnace and a method of operating such furnace, which can simplify the mechanism of forwarding a casting line and thereby curtail the casting process time, the casting line consisting of a series of mold frames, each of which is equipped with a plurality of pouring gates.

A pressure-type pouring furnace of the invention comprises a molten metal chamber containing molten metal within a furnace body, a receiving siphon and a pouring siphon both communicating with each other at the bottom of the molten metal chamber, a furnace cover sealably covering the top of the molten metal chamber, and a pressuring unit connected to the furnace cover. In such a furnace, a plurality of pouring nozzles are arranged above the pouring chamber on top of the pouring siphon a distance apart from each other, and each of the plurality of pouring nozzles is provided with a stopper enabling it to be opened and closed from above. In the pressure-type pouring furnace, a desired time difference may be given to time intervals during which the respective stoppers are open.

In the invention, by controlling the pressuring unit to open and close the stoppers, the molten metal can be poured to different molds and the like simultaneously from a plurality of pouring nozzles arranged above the pouring chamber of the pressure-type pouring furnace a distance apart from each other. Therefore, the molten metal in the pouring chamber can be poured forming a continuous, slag-free stream, with additional advantage of satisfactory metal flow start and stop and curtailed pouring time. When a desired time difference is given to time intervals during which the stoppers are open, respectively, the pouring gate A can pour a quantity of molten metal corresponding to a time interval $P_a$, while the pouring gate B can pour a quantity of molten metal corresponding to a time interval $P_b$ to each mold.

DETAILED DESCRIPTION OF THE INVENTION

Figure 1:
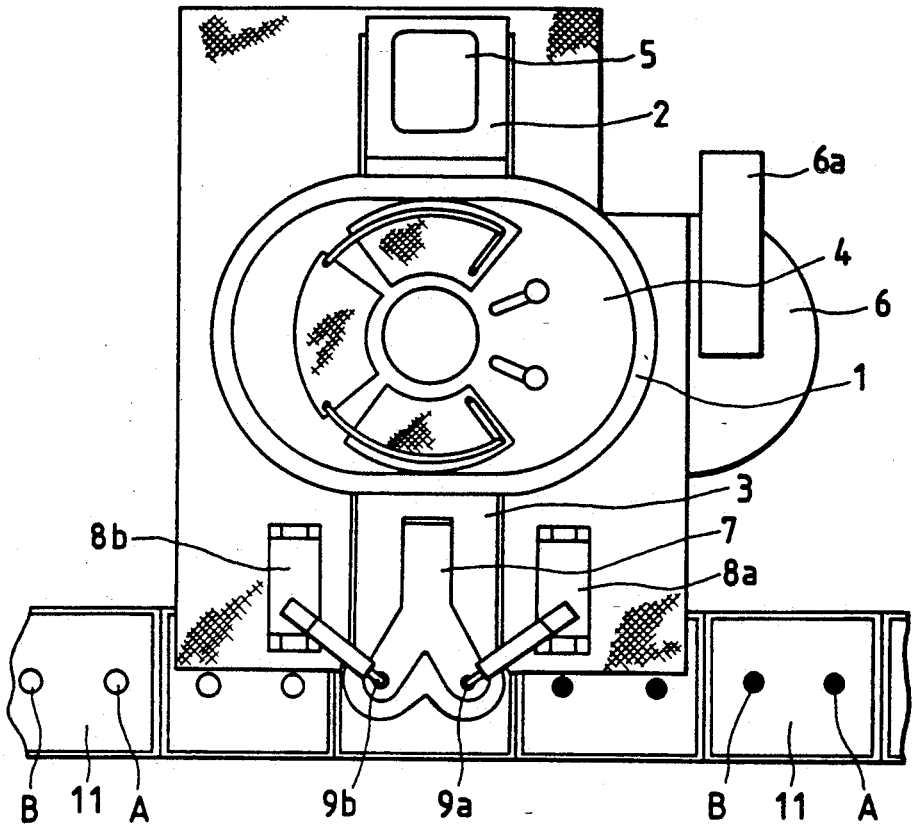
FIG. 1 is a plan view of an embodiment of the invention.
Figure 2:
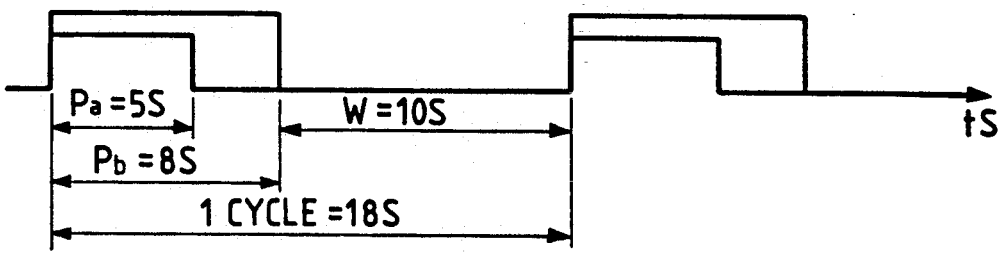
FIG. 2 is a time chart for operating the embodiment shown in FIG. 1.

FIG. 1 is a plan view of an embodiment; and FIG. 2 is a time chart according to which the apparatus shown in FIG. 1 is operated. In FIG. 1, a pressure-type pouring furnace includes: a molten metal chamber 1 containing molten metal within the furnace body, a receiving siphon 2 and a pouring siphon 3 communicating with each other at the bottom of the molten metal chamber a furnace cover 4 sealably covering the top of the molten metal chamber 1, and a pressuring unit (not shown) connected to the furnace cover. The molten metal poured from a receiving chamber 5 and deposited in the molten metal chamber 1 is heated and maintained as heated by an inductor 6 made up of an iron core 6*a* and an induction heating coil (not shown).

Figure 7:
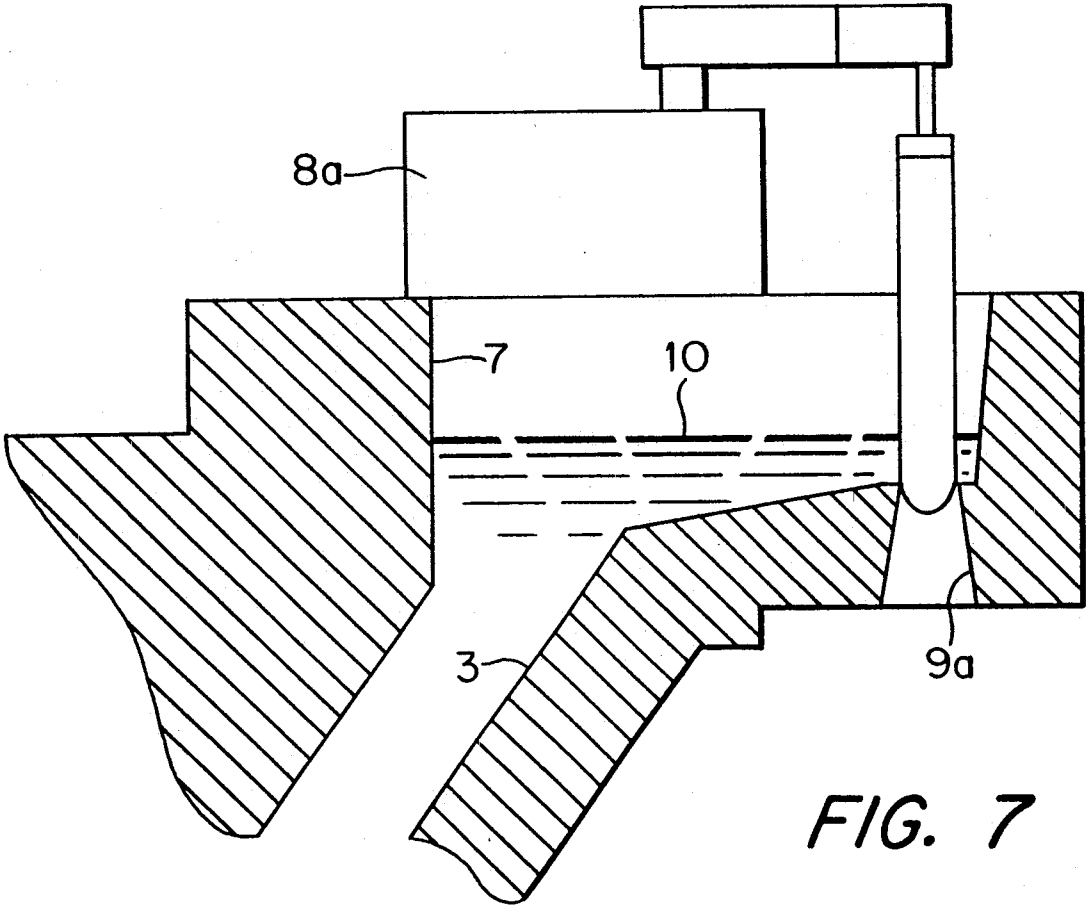
FIG. 7 is a cross-sectional side view of the pouring chamber of the embodiment illustrated in FIG. 1.

A featured structure of this embodiment is that a pouring chamber 7 on top of the pouring siphon 3 is Y-shaped so as to be bilaterally symmetrical, and that pouring nozzles 9*a*, 9*b* are provided on the bifurcated ends, respectively. Stoppers which can be opened and closed from above by stopper units 8*a*, 8*b* are disposed on these pouring nozzles. A series of casting mold frames 11, each being identical in structure and arranged at the same pitch, are forwarded by a forwarding unit (not shown) below the pouring nozzles 9*a*, 9*b*. FIG. 7 illustrates the pouring chamber 7, pouring siphon 3, stopper unit 8*a*, and pouring nozzle 9*a* from a cross-sectional side perspective of the embodiment illustrated in FIG. 1. The pitch between pouring gates A and B arranged on each mold frame 11 is designed to be the same as that between the pouring nozzles 9*a* and 9*b*.

Figure 3:
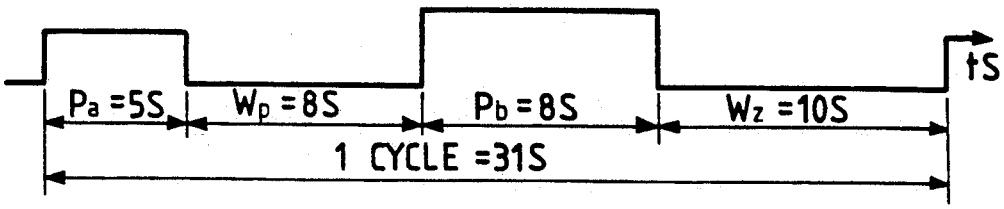
FIG. 3 PRIOR ART
FIG. 3 is a time chart showing an operation plan of a conventional example 1.
Figure 4:
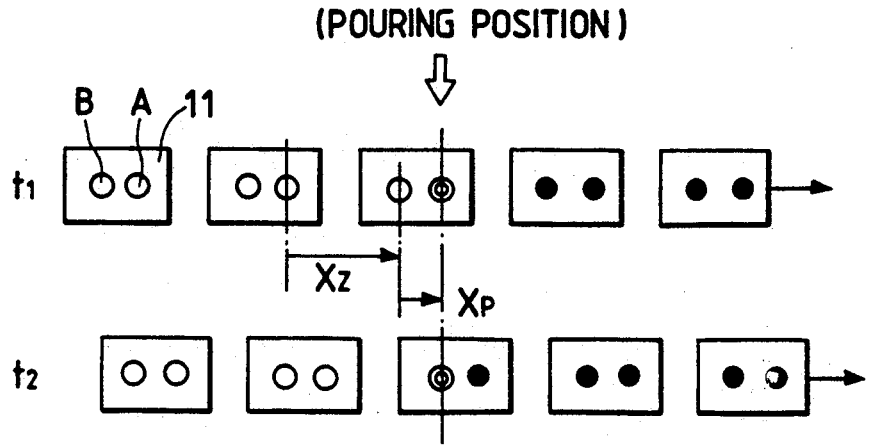
FIG. 4 PRIOR ART
FIG. 4 is a plan view showing an operation plan of the conventional example 1.
Figure 5:
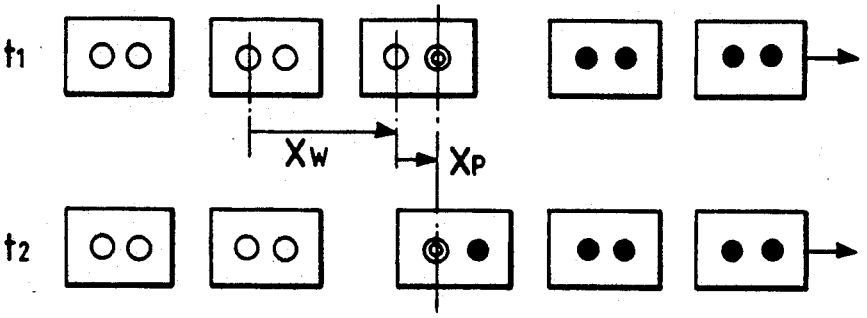
FIG. 5 PRIOR ART
FIG. 5 is a plan view showing an operation plan of a conventional example 2.
Figure 6:
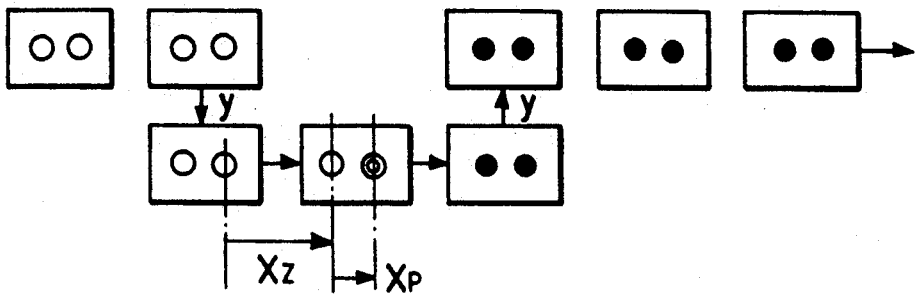
FIG. 6 PRIOR ART
FIG. 6 is a plan view showing an operation plan of a conventional example 3.

According to this construction, the relative position of the two pouring nozzles 9*a* and 9*b* is determined so as to correspond to the relative position of the two pouring gates A and B disposed on each mold frame 11 for the series of equidistantly arranged identical casting mold frames, so that the molten metal can be poured to the two pouring gates A and B of the single mold frame 11 simultaneously. Upon completion of pouring, the series of mold frames can be forwarded by the pitch of the mold frame. In this case, a desired time difference may be given to time intervals during which the stoppers are open. For example, as shown in FIG. 2, the molten metal is poured to the pouring gate A for a time interval $P_a$ and to the pouring gate B for a time interval $P_b$. Reference character W designates a time interval required to forward the series of mold frames by an arrangement pitch; a single cycle lasting 18 seconds as shown in FIG. 2. This cycle is about 40% shorter than 31 seconds of a cycle adopted in the conventional example 1 shown in FIG. 3, which also reduces the number of forwarding movements per cycle from two to one. The rate of metal flow may be changed by changing the diameter of each pouring nozzle. Pouring time control may be applied at the same time. As a result, the molten metal can be poured in different quantities to different molds within a single mold frame having the pouring gates A and B. Unlike a furnace without stopper, which depends only on pressure control, this embodiment, using the stoppers, can ensure that the molten metal in the pouring chamber will flow continuously without being disturbed by slag. Thus, by controlling the pressure within the molten metal chamber 1 so as to be increased gradually, satisfactory metal flow start and stop can be achieved with the additional advantage of curtailed pouring time.

The pressure-type pouring furnace of the invention includes a molten metal chamber containing molten metal within the furnace body, a receiving siphon and a pouring siphon communicating with each other at the bottom of the molten metal chamber, a furnace cover sealably covering the top of the molten metal chamber, and a pressuring unit connected to the furnace cover. In such a pressure-type pouring furnace, a plurality of pouring nozzles are provided on a pouring chamber on top of the pouring siphon a distance apart from each other, and stoppers are arranged on the plurality of pouring nozzles, respectively. Therefore, the molten metal can be poured from the plurality of pouring nozzles to different molds simultaneously, which permits slag-free, continuous flow of the molten metal within the pouring chamber, hence providing advantages of satisfactory metal flow start and stop as well as reduced pouring time. As a result, for a series of mold frames, each of which is arranged at the same pitch and has a plurality of pouring gates, the pouring operation to the plurality of pouring gates of a single mold frame can be completed at once, which then eliminates the necessity of forwarding the mold frame for every pouring gate. Thus, by forwarding the series of mold frames by the mold frame arrangement pitch, not only is the pouring cycle is reduced, but also the forwarding unit can be made simple in design.

Further, in the conventional method which pours the molten metal to a plurality of pouring gates of a single mold frame by pouring into each individual pouring gate in sequence, heat conduction in the mold frame becomes different locally so that it takes time before a uniform temperature distribution is obtained over the entire part of the mold frame. On the contrary, the method of the invention involves the pouring of the molten metal to the plurality of pouring gates simultaneously, thereby allowing a uniform temperature distribution to be obtained at once. Accordingly, the percent of defective products can be reduced significantly.

Still further, when a desired time difference is given to time intervals during which the stopper are open, there is obtained the advantage of allowing the molten metal to be poured in different quantities to each mold.

What is claimed is:

1. A pressure pouring furnace for pouring molten metal into a plurality of pouring gates disposed on a mold frame, said pressure pouring furnace comprising:
   - a furnace body having a molten metal chamber containing molten metal;
   - a receiving siphon and a pouring siphon disposed in communication with each other at a bottom portion of said molten metal chamber;
   - a furnace cover sealably covering a top portion of said molten metal chamber;
   - a pressuring unit connected to said furnace cover and communicating with an interior portion of said molten metal chamber for controlling the pressure within said molten metal chamber;
   - a pouring chamber connected to said pouring siphon; and
   - a plurality of pouring nozzles arranged in said pouring chamber, each of said pouring nozzles being arranged at a predetermined distance apart from the other pouring nozzles, and each of said pouring nozzles having a stopper for opening and closing the respective nozzle, wherein said predetermined distance between said respective pouring nozzles is substantially identical to a distance between said respective pouring gates of said mold frame to which said molten metal is poured.

2. A pressure pouring furnace according to claim 1, wherein diameters of said respective pouring nozzles are different from each other.

3. A pressure pouring furnace as defined in claim 1, further comprising means for controlling each of said stoppers to open respective pouring nozzles for different predetermined time intervals.

4. A pressure pouring device for pouring molten metal into a plurality of pouring gates disposed on a mold frame, said pressure pouring device comprising:

a pouring chamber;

a pouring siphon, connected to said pouring chamber, for connecting said pouring chamber to a pressurized source of molten metal; and a plurality of pouring nozzles arranged in said pouring chamber, each of said pouring nozzles being arranged at a predetermined distance apart from the other pouring nozzles, and each of said pouring nozzles having a stopper for opening and closing the respective nozzle, wherein said predetermined distance between said respective pouring nozzles is substantially identical to a distance between said respective pouring gates of said mold frame into which said molten metal is poured.

5. A pressure pouring device according to claim 4, wherein diameters of said respective pouring nozzles are different from each other.

6. A pressure pouring device as defined in claim 4, further comprising means for controlling each of said stoppers to open respective pouring nozzles for different predetermined time intervals.

7. A pressure pouring furnace comprising:

a furnace body having a molten metal chamber containing molten metal;

a receiving siphon and a pouring siphon disposed in communication with each other at a bottom portion of said molten metal chamber;

a furnace cover sealably covering a top portion of said molten metal chamber;

a pressuring unit connected to said furnace cover and communicating with an interior portion of said molten metal chamber for controlling the pressure within said molten metal chamber;

a pouring chamber connected to said pouring siphon; and a plurality of pouring nozzles arranged in said pouring chamber, each of said pouring nozzles being arranged at a predetermined distance apart from the other pouring nozzles, and each of said pouring nozzles having a stopper for opening and closing the respective nozzle, wherein respective diameters of said pouring nozzles are different from each other.

8. A pressure pouring furnace as defined in claim 7, further comprising means for controlling each of said stoppers to open respective pouring nozzles for different predetermined time intervals.

9. A pressure pouring furnace comprising:

a furnace body having a molten metal chamber containing molten metal;

a receiving siphon and a pouring siphon disposed in communication with each other at a bottom portion of said molten metal chamber;

a furnace cover sealably covering a top portion of said molten metal chamber;

a pressuring unit connected to said furnace cover and communicating with an interior portion of said molten metal chamber for controlling the pressure within said molten metal chamber;

a pouring chamber connected to said pouring siphon;

a plurality of pouring nozzles arranged in said pouring chamber, each of said pouring nozzles being arranged at a predetermined distance apart from the other pouring nozzles, and each of said pouring nozzles having a stopper for opening and closing the respective nozzle; and means for controlling each of said stoppers to open respective pouring nozzles for different predetermined time intervals.

10. A pressure pouring device for pouring molten metal into a mold frame, said pressure pouring device comprising:

a pouring chamber;

a pouring siphon, connected to said pouring chamber, for connecting said pouring chamber to a pressurized source of molten metal; and a plurality of pouring nozzles arranged in said pouring chamber, each of said pouring nozzles being arranged at a predetermined distance apart from the other pouring nozzles, and each of said pouring nozzles having a stopper for opening and closing the respective nozzle, wherein respective diameters of said pouring nozzles are different from each other.

11. A pressure pouring device as defined in claim 10, further comprising means for controlling each of said stoppers to open respective pouring nozzles for different predetermined time intervals.

12. A pressure pouring device for pouring molten metal into a mold frame, said pressure pouring device comprising:

a pouring chamber;

a pouring siphon, connected to said pouring chamber, for connecting said pouring chamber to a pressurized source of molten metal;

a plurality of pouring nozzles arranged in said pouring chamber, each of said pouring nozzles being arranged at a predetermined distance apart from the other pouring nozzles, and each of said pouring nozzles having a stopper for opening and closing the respective nozzle; and means for controlling each of said stoppers to open respective pouring nozzles for different predetermined time intervals.

* * * * *